United States Patent [19]

Iwai et al.

[11] 4,360,944

[45] Nov. 30, 1982

[54] TONER TRANSPORTING DEVICE FOR AN ELECTROSTATIC RECORDING APPARATUS

[75] Inventors: Fumio Iwai; Junichi Koiso; Tsugio Hirabayashi; Hiroaki Ura, all of Hachioji, Japan

[73] Assignee: Konishiroku Photo Industry Co., Ltd., Japan

[21] Appl. No.: 240,805

[22] Filed: Mar. 5, 1981

[30] Foreign Application Priority Data

Mar. 6, 1980 [JP] Japan ..... 55-28237[U]

[51] Int. Cl.[3] ..... G03G 21/00

[52] U.S. Cl. ..... 15/256.51; 118/652; 355/15

[58] Field of Search ..... 15/256.51, 256.52, 256.53, 15/256.5; 355/15; 118/652

[56] References Cited

U.S. PATENT DOCUMENTS

| | | | |
|---|---|---|---|
| 3,957,509 | 5/1976 | McMullen | 355/15 |
| 4,054,381 | 10/1977 | Bernhard | 355/15 |
| 4,218,131 | 8/1980 | Ito et al. | 355/15 |
| 4,297,021 | 10/1981 | Tani et al. | 355/15 |

*Primary Examiner*—Edward L. Roberts

*Attorney, Agent, or Firm*—Jordan B. Bierman; Linda Bierman

[57] ABSTRACT

A toner transporting device for an electrophotographic copying apparatus includes a transporter for carrying toner to and into a chamber through a first opening therein, a second opening in the chamber through which toner in the chamber is moved out of the same in a different direction, and an elastic plate mounted at one of its ends for rotation within the chamber such that its opposite tip end is maintained in contact with the interior wall of the chamber except at the second chamber opening so as to move toner from the first to and through the second chamber opening.

2 Claims, 6 Drawing Figures

TONER TRANSPORTING DEVICE FOR AN ELECTROSTATIC RECORDING APPARATUS

BACKGROUND OF THE INVENTION

1. Field of the Invention

The present invention relates to used toner recovering means in electrostatic recording apparatus, such as electrophotographic copying machines, and more particularly to transport means for directing the remaining toner from a cleaning device to a transport member which carries the toner to a developing device.

2. Description of the Prior Art

Residual toner from the surface of an image forming member of an electrostatic recording apparatus, such as an electrophotographic copying machine, has generally been disposed of by replacing the web used for cleaning the toner remaining on the image forming area after completion of image formation, or by discarding the used toner deposited in a cleaning device after a definite period of copying operations. However, the performance of such laborious maintenance practices at regular or irregular intervals is expensive at least insofar as the employee time involved. In addition, with the relatively recent advent of high-speed copiers, increases in the number of copying sheets used correspondingly increases the discharged volume of used toner, leading to demands that the toner collected and deposited by the cleaning means be automatically recovered and returned to the developing device.

To meet such demands, new recovery means have been proposed such, for example, as those disclosed in Japanese Patent Publication Open to Public Inspection (hereinafter referred to as Japanese Pat. O.P.I. Publication) No. 45933/1972 wherein an endless bead chain circulates between the cleaning means and the toner replenishing means; Japanese Pat. O.P.I. Publication No. 71649/1973 utilizing a screw conveyor; Japanese Pat. O.P.I. Publication No. 3636/1975 providing a rotary means rotatable coaxially with a photosensitive drum; U.S. Pat. No. 3,333,572 and No. 3,405,682 incorporating a belt conveyor; and the like.

However, toner recovered by the cleaning means, irrespective of the manner in which it is transported, must be transported along the surface of the photosensitive body to either one or both ends thereof in order to place the recovered toner on the transport means provided at the end of the photosensitive body. And having reached one end of the photosensitive body—even in the above-described known art—return of the toner to the development section by the shortest possible route necessitates that the transport direction be changed perpendicular to the direction in which the toner has been carried to reach the end of the photosensitive body.

In this change of transport direction, a number of problems have arisen—for example, the toner, because it is formed of very minute particles, tends to form lumps during its transport along the surface of the photosensitive body; because it is in powder form, the toner tends to scatter and leak through small gaps within the apparatus, staining the interior thereof; when the toner, at the point of transport direction change, does not successfully ride in the subsequent transport means, it is prone to becoming mixed with deteriorated toner produced by friction between toner particles; and, in the worst case, unsatisfactory transportation produces an excessive accumulation of toner in the chamber of the cleaning means which can thereby become ineffective in its cleaning function, thus leading to possible malfunction in the recycling of toner.

SUMMARY OF THE INVENTION

The present invention, is an effort to solve the foregoing problems, provides a transport direction changing device comprising a chamber having a first opening to enable receipt in the chamber of used toner that has been delivered along the surface of the photosensitive body from the cleaning device, a second opening through which toner in the chamber is moved out of the chamber in a direction perpendicular to that in which the toner entered the chamber, and an elastic rotary plate in the chamber for moving the toner therewithin. The present invention will now be described in detail by reference to the disclosed embodiments thereof as shown in the accompanying drawings.

DETAILED DESCRIPTION OF THE PREFERRED EMBODIMENTS

Figure 1:
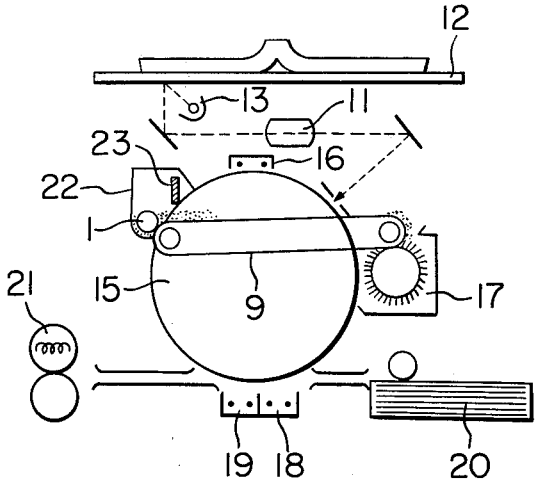
FIG. 1 is a conceptual showing of a copying apparatus.

FIG. 1 is a conceptual showing of the overall constitution of a copying apparatus embodying the present invention. A document sheet placed on a conventional copy board 12 of transparent material, as a glass plate, is lit by an exposure lamp 13, the light reflected from the document travelling through an optical system such as lens 11 onto an image-forming photosensitive member 15 to form a light image thereon. Around photosensitive member 15 there are provided a charger 16, a developing device 17, and transfer and separation electrodes 18 and 19. The numeral 21 identifies a fixing device which fixes the toner image transferred onto a recording sheet 20, while 22 denotes a cleaning device for removing residual toner remaining on photosensitive body 15 after transfer of the toner image thereon to recording sheet 20, the cleaning device being provided with a cleaning blade 23. The removed toner is transported by transport means 1 to either of the ends of the cleaning device. A belt conveyor 9 is trained over and between cleaning device 22 and developing device 17. The used toner is delivered to one end of the cleaning device, its transporting direction is changed at this point, and the toner is then loaded onto belt conveyor 9.

Figure 2:
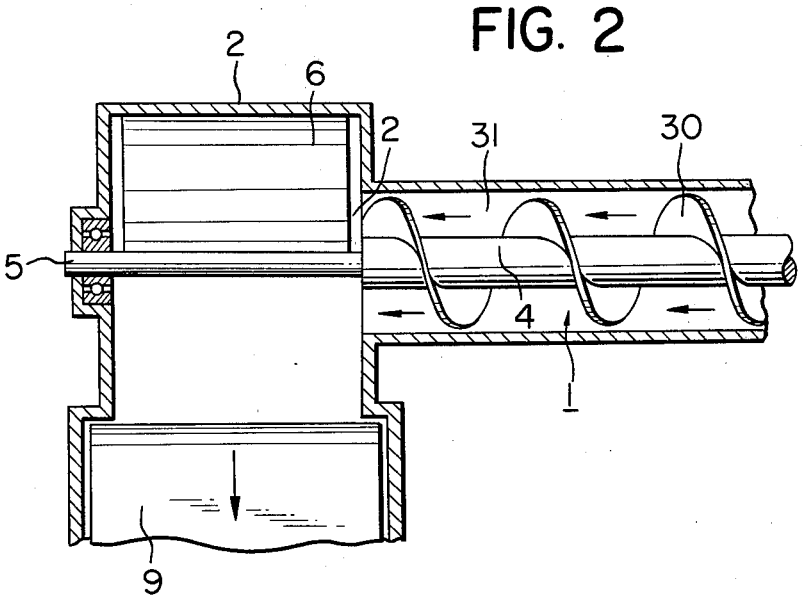
FIG. 2 is an elevated sectional view, taken in parallel with the axis of the photosensitive body, of a transport means in accordance with the present invention.
Figure 3:
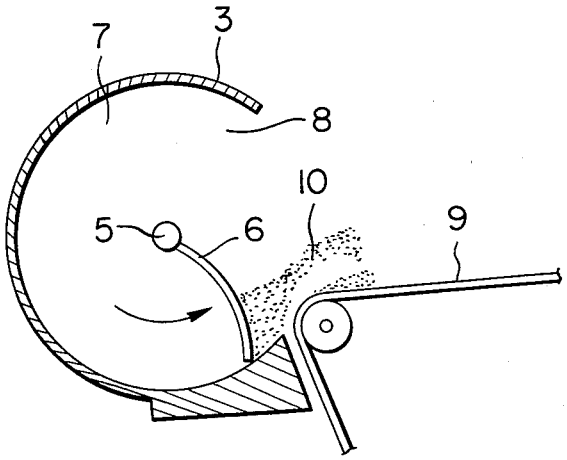
FIG. 3 is an elevated sectional view, taken perpendicular to the axis of the photosensitive body, of the transport means of FIG. 2.

FIGS. 2 and 3 illustrate an embodiment of the toner transport direction changing means of the present invention wherein, in order to recycle used toner removed from the surface of the photosensitive member by a cleaning blade and the like, the toner is delivered by a transport means provided inside the cleaning device. For example, transport means 1 is shown as a screw-type conveyor comprising an axis or shaft 4 which carries a spiral thread 20 supported for rotation in a channel 31 in substantially parallel relation to cleaning blade 23. Toner transported by and axially along spiral thread 30 is introduced into a chamber 3 through a first opening 2 defined therein. An elastic plate 6 disposed within chamber 3 is securely fixed at one of its ends to an extension 5 of the shaft 4 of transport means 1 for common and concurrent rotation of plate 6 with shaft 4. Since plate 6 is slightly longer than the radius of chamber 3, as it rotates its tip end opposite that secured to shaft extension 5 contacts the interior wall surface 7 of chamber 3 to sweep used toner therefrom and to direct the swept toner out of chamber 3 through a second opening 8 defined therein. Toner is directed from chamber 3 through second opening 8—in a direction substantially perpendicular to that in which the used toner is transported by transport means 1 into chamber 3—and onto endless belt 9 for return to the developing device or the like.

Elastic plate 6 is preferably a thin metallic plate formed of a metal such as phosphor bronze or stainless steel or the like, or may alternatively comprise a thin, elastic resin plate formed of a resin such as polyester or polyethylene or the like. Experimental results have shown that a stainless steel plate with a thickness of from 20 to 150 um or a resin plate formed of polyester with a thickness of from 60 to 200 um is preferred. The interior wall 7 of chamber 3 may have a normal metallic or resinous surface which may also be coated thereover with Teflon or the like for reducing wear on the tip of elastic plate 6.

Because elastic plate 6 rotates while being pressed due to its elasticity against interior wall 7 of chamber 3, the used toner delivered into chamber 3 is completely swept out by elastic plate 6, the force of such sweeping additionally pulverizing lumps of the toner formed during its transportation by transport means 1.

When rotating elastic plate 6 reaches second opening 8 of chamber 3, the plate is released from being pressed against interior wall 7 and the repulsive force of the released plate springs or throws the swept toner 10 through second opening 8. The toner so thrown or moved out of chamber 3 through second opening 8 is there effectively loaded onto endless belt 9 which rotates in close proximity to chamber 3.

In the example shown in FIG. 4, rotary elastic plate 6 rotates opposite to the direction of the preceding example, and another elastic plate 11 is fixed in the proximity of second opening 8 at the lower wall portion of chamber 3. Elastic plate 11 has the same width as that of rotary elastic plate 6, and is additionally of such a length and so disposed that its tip is in or nearly in contact with shaft 5 of rotary elastic plate 6. The material of plastic plate 11 may be similar to that of elastic plate 6, but need not necessarily be the same.

Figure 4C:
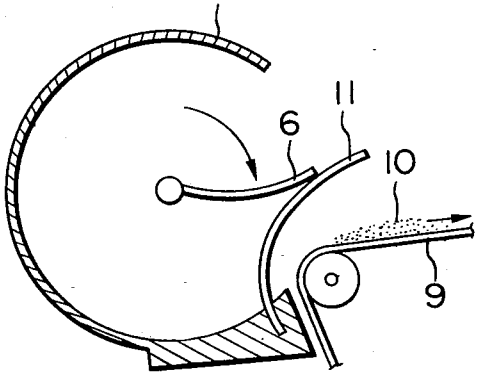
FIGS. 4A, 4B and 4C are operatively sequential, elevated sectional views of another embodiment of the invention.
Figure 4B:
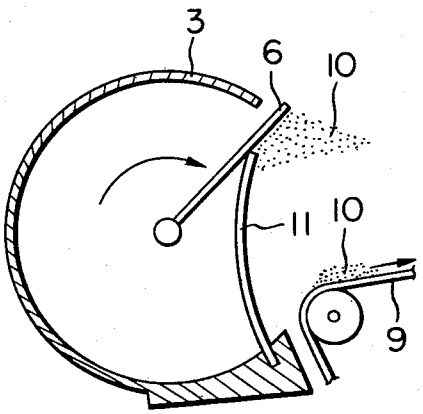
Figure 4A:
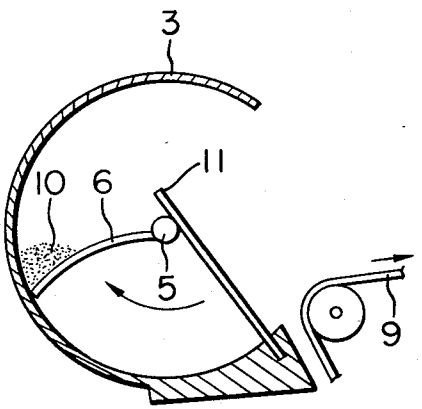

The sequential changes in operating position of the various elements of this second embodiment are shown in FIGS. 4A through 4C. Toner 10 swept from chamber wall 7 by rotary elastic plate 6 is thrown or discharged from chamber 3 by the repulsive force of elastic plate 6 as plate 6 reaches second opening 8. As rotation of plate 6 continues, it contacts fixed elastic plate 11 to scrape from the surface of rotating plate 6 residual toner remaining on its surface.

In the illustrated example, toner 10 is thrown from chamber 3 at the high point of second opening 8, thereby providing effectively wide scattering of the toner on belt 9; nevertheless, the degree of toner scattering can be reduced as desired.

The rotative direction, material, and configuration of the elastic plate may be arbitrarily determined and modified within the scope of the present invention, and a plurality of such plates may also be employed.

What is claimed is:

1. In an electrostatic recording apparatus including a cleaning device for removing residual toner remaining on the surface of an image forming member after completion of a copying cycle, and a transport means for transporting residual toner removed by the cleaning device from the surface of the image forming member, the improvement comprising:

a chamber having an interior wall, a first opening through which residual toner removed from the surface of the image forming member is introduced into the chamber from the transport means, and a second opening through which the residual toner introduced into said chamber is moved out of said chamber in a different direction, and at least one elastic plate mounted at one end for rotation within said chamber to move toner from said chamber through said second opening, said interior wall of said chamber being so configured and positioned relative to said rotating plate that the other end of said plate remains in contact with said interior wall except at said second chamber opening.

2. In an apparatus in accordance with claim 1, wherein the transport means comprises a screw-type conveyor having a rotatable shaft carrying a spiral thread, said elastic plate being fixed to an extension of said shaft to effect simultaneous rotation of said plate and said spiral thread.

* * * * *